US008070271B2

(12) United States Patent
Ito

(10) Patent No.: US 8,070,271 B2
(45) Date of Patent: Dec. 6, 2011

(54) LIQUID TRANSFER DEVICE AND MANUFACTURING METHOD THEREOF

(75) Inventor: Atsushi Ito, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 493 days.

(21) Appl. No.: 12/362,068

(22) Filed: Jan. 29, 2009

(65) Prior Publication Data

US 2009/0189961 A1 Jul. 30, 2009

(30) Foreign Application Priority Data

Jan. 30, 2008 (JP) ..... 2008-018986

(51) Int. Cl.
*B41J 2/175* (2006.01)
*B41J 2/045* (2006.01)

(52) U.S. Cl. ..... 347/85; 347/71; 347/72

(58) Field of Classification Search ..... 347/71–72
See application file for complete search history.

(56) References Cited

U.S. PATENT DOCUMENTS 6,955,418 B2 10/2005 Ito
7,246,889 B2 7/2007 Kanada et al.

FOREIGN PATENT DOCUMENTS

JP 2004-25636 1/2004
JP 2005-22137 1/2005

*Primary Examiner* — Matthew Luu
*Assistant Examiner* — Lisa Solomon
(74) *Attorney, Agent, or Firm* — Frommer Lawrence & Haug LLP

(57) ABSTRACT

A liquid transfer device of the present invention includes a passage unit, an energy supplier, and a supporter. In the passage unit, a common liquid chamber and a plurality of individual passages branching off from the common liquid chamber are formed. Such a passage unit includes a plurality of plates which are laminated on one another and include a first plate having a hole constituting the common liquid chamber and a second plate. The energy supplier supplies, to liquid in the individual passages, energy for transferring the liquid. The supporter projects inwardly from a side wall defining the hole formed on the first plate, and is continuous from one end to the other end of the common liquid chamber in a laminating direction of the plates so as to support the second plate in the laminating direction.

16 Claims, 16 Drawing Sheets

LIQUID TRANSFER DEVICE AND MANUFACTURING METHOD THEREOF

CROSS REFERENCE TO RELATED APPLICATION

This application claims priority from Japanese Patent Application No. 2008-018986, which was filed on Jan. 30, 2008, the disclosure of which is herein incorporated by reference in its entirety.

BACKGROUND OF THE INVENTION

1. Field of the Invention

The present invention relates to a liquid transfer device and manufacturing method thereof.

2. Description of Related Art

There has been widely used in various fields liquid transfer devices each of which includes a common liquid chamber and individual passages branching off from the common liquid chamber and which transfers liquid by applying pressure to liquid in the individual passages. Among these liquid transfer devices is a liquid transfer device whose passage unit has liquid passages including a common liquid chamber and individual passages are formed by laminating a plurality of plates each having holes constituting liquid passages.

Japanese Unexamined Patent Publication No. 25636/2004 (Tokukai 2004-25636) discloses the following ink-jet head, particularly with reference to FIG. 6. Namely, the ink-jet head has a passage unit having ink passages. These ink passages include a common ink chamber and individual ink passages. Each individual ink passage branches off from the common ink chamber and connects to a nozzle, via a pressure chamber. From the nozzle are ejected ink droplets. The passage unit of the ink-jet head is formed by laminating the following plates: a synthetic resin plate having nozzles; and a plurality of metal plates having holes constituting ink passages which lead to the nozzles. The ink passages are constituted by pressure chambers, common ink chambers and the like. The publication discloses that the plates are bonded with one another by applying an adhesive to the plates and applying heat and pressure in the direction of laminating the plates (the direction is hereinafter simply referred to as "laminating direction").

Japanese Unexamined Patent Publication No. 22137/2005 (Tokukaihei 2005-22137) discloses an ink-jet head having a passage unit formed by laminating a plurality of plates having holes constituting the ink passages. To bond these plates with one another, the publication describes dispersing of metal atoms among the plates, in addition to application of a high pressure in the laminating direction under a high temperature conditions.

Among the ink passages formed in the passage unit, the common ink chamber which branches into individual ink passages and serves as the source of ink supply is required to have a relatively large capacity to retain a large amount of ink. For this reason, the hole(s) constituting the common ink chamber (hereinafter simply referred to as "the hole(s)") in general have a relatively large opening area. Therefore, when a pressure is applied to the plates in the laminating direction as in the cases of the above two publications, the pressure may cause deformation in a side wall defining the hole. The deformation may further leads to a problem of insufficient bonding between the plates. These problems are particularly noticeable when the plates are bonded with one another by metal diffusion bonding as in the latter case, because metal diffusion bonding requires application of a considerably high pressure.

In view of that, in the latter case, the opening area of the holes on manifold plates are made different from one another in such a manner that a manifold plate in an upper layer in the laminating direction has a smaller hole than one in the lower layer. This restrains the above described pressure-caused deformation.

SUMMARY OF THE INVENTION

The latter case however has the following problem. Namely, opening areas of the hole on an upper plate out of the manifold plates are smaller than those on a lower plate. Therefore, the capacity of the common ink chamber is small. Accordingly, to ensure a certain capacity in the common ink chamber, the number of manifold plates needs to be increased. This however causes problems such as: an increase in the size of the head, which is attributed to an increase in the thickness; and an increase in the costs. Further, the difference in opening areas of holes among the manifold plates causes intricate cross section of the common ink chamber, consequently increasing the passage resistance in the common ink chamber.

An object of the present invention therefore is to provide a liquid transfer device and manufacturing method thereof, in which: (i) an increase in the number of plates constituting a common liquid chamber is restrained; (ii) an increase in the passage resistance in the common liquid chamber is restrained; and (iii) deformation in a side wall defining the hole constituting the common liquid chamber is restrained.

The first aspect of the present invention is a liquid transfer device including a passage unit, an energy supplier, and a supporter. In the passage unit, a common liquid chamber and a plurality of individual passages branching off from the common liquid chamber are formed. Such a passage unit includes a plurality of plates which are laminated on one another and include a first plate having a hole constituting the common liquid chamber and a second plate. The energy supplier supplies, to liquid in the individual passages, energy for transferring the liquid. The supporter projects inwardly from a side wall defining the hole formed on the first plate, and is continuous from one end to the other end of the common liquid chamber in a laminating direction of the plates so as to support the second plate in the laminating direction.

The second aspect of the present invention is a method of manufacturing a liquid transfer device, the device including: a passage unit in which a common liquid chamber and a plurality of individual passages branching off from the common liquid chamber are formed; and an energy supplier which supplies, to liquid in the individual passages, energy for transferring the liquid. The method includes the steps of: (A) forming holes to constitute the common liquid chamber and the individual passages, on a plurality of plates included in the passage unit; (B) laminating the plates on one another; and (C) bonding the plates having been laminated in (B) by applying a pressure in the laminating direction. In (A), a hole constituting the common liquid chamber and a supporter projecting inwardly from a side wall defining the hole are formed on a first plate which is included in the plates. In (B), the plates are laminated on one another so that the supporter of the first plate is continuous from one end to the other end of the common liquid chamber in the laminating direction.

In the first and second aspect of the present invention, the supporter of the first plate supports a portion of the second plate facing the supporter in the laminating direction, when a pressure in the laminating direction is applied to the plates, at the time of bonding the plates. The pressure therefore is dispersed and applied also to the portion of the second plate facing the supporter in the laminating direction, through the supporter. This restrains deformation of the side walls.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

The following describes a preferred embodiment of the present invention, with reference to the attached drawings. The following embodiment deals with a case of applying a liquid transfer device of the present invention to an ink-jet head of an ink-jet printer, which transfers ink to nozzles and ejects ink droplets from the nozzles to a recording sheet.

Figure 1:
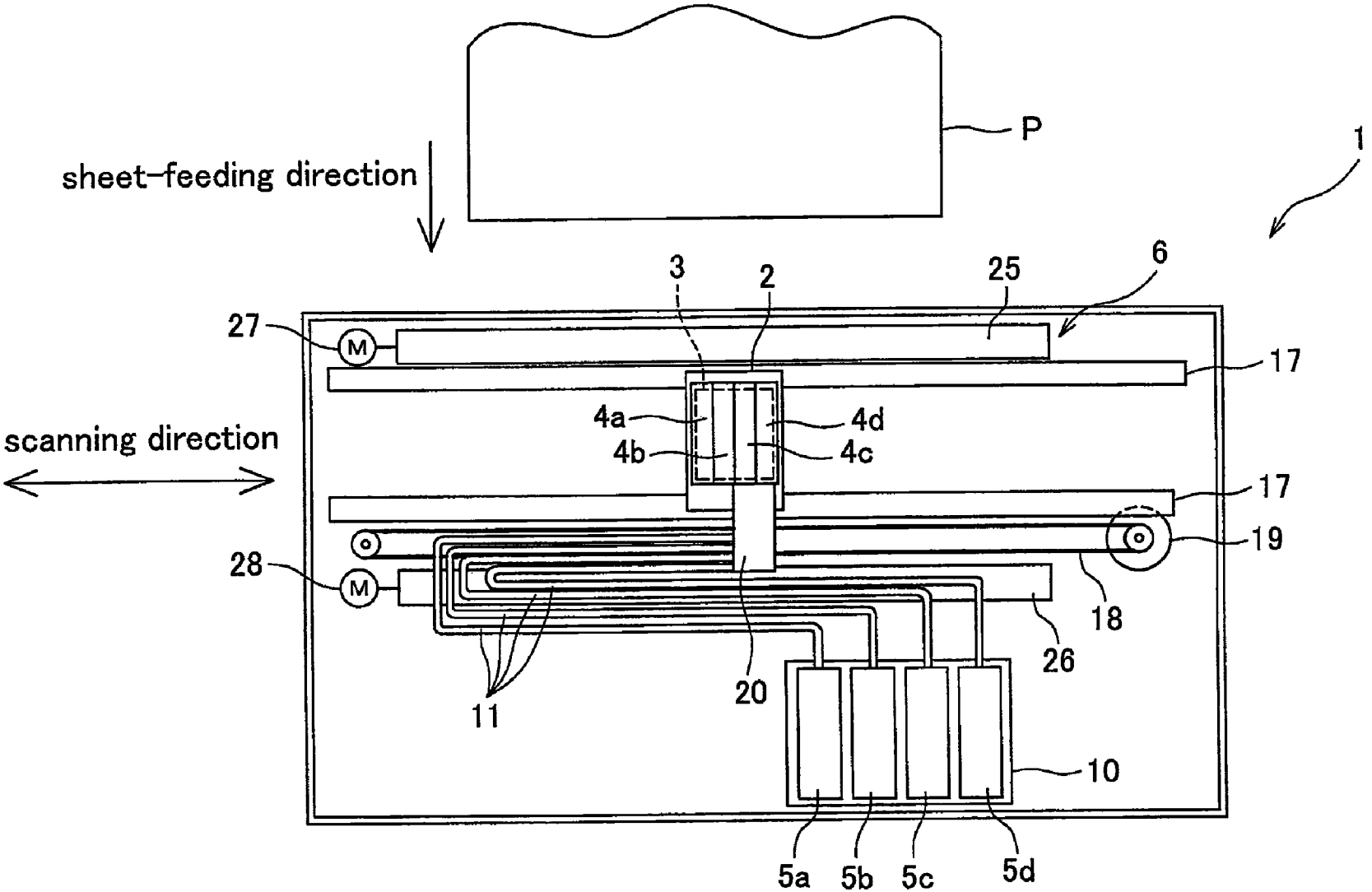
FIG. 1 is a schematic plane view of an ink-jet printer including an ink-jet head of one embodiment according to the present invention.

First described is the schematic configuration of the ink-jet printer 1 including an ink-jet head of the present embodiment. FIG. 1 is a schematic plane view of the ink-jet printer 1. As illustrated in FIG. 1, the printer 1 includes: a carriage 2 capable of moving back and forth along a scanning direction; four ink-jet heads 3; four sub tanks 4*a* to 4*d*; four ink cartridges 5*a* to 5*d* for retaining ink of different colors used in the heads 3; and a conveyor 6 which transfers a recording sheet P in a sheet-feeding direction.

The carriage 2 is connected to an endless belt 18 extending in the scanning direction. The endless belt 18 is run by the carriage drive motor 19. As the endless belt 18 runs, the carriage 2 moves in the scanning direction along a pair of guide shafts 17 extending in the scanning direction.

On the carriage 2 are mounted ink-jet head 3 and sub tanks 4*a* to 4*d*. The ink-jet head 3 has a plurality of nozzles 54 on its under surface (the surface on the far side when viewing FIG. 1 orthogonally to the sheet surface; see also FIG. 2). The sub tanks 4*a* to 4*d* are arranged side by side in the scanning direction. To these sub tanks 4*a* to 4*d*, a tube joint 20 connected to flexible tubes 11 is integrally provided. Through the tubes 11, sub tanks 4*a* to 4*d* are connected to the ink cartridges 5*a* to 5*d*, respectively.

The ink cartridges 5*a* to 5*d* retains: black ink, yellow ink, cyan ink, magenta ink, respectively. Further, the ink cartridges 5*a* to 5*d* are detachably attached to a holder 10 fixed to the printer 1.

The inks of the different colors respectively stored in the ink cartridges 5*a* to 5*d* are supplied to the sub tanks 4*a* to 4*d* via the tubes 11, and temporarily retained in the sub tanks 4*a* to 4*d*. The inks are then supplied to the ink-jet head 3. The ink-jet head 3, while moving back and forth in the scanning direction along with the carriage 2, ejects ink droplets of different colors from the plurality of nozzles 54 (see FIG. 2) provided on the under surface, to a recording sheet P conveyed in the sheet-feeding direction by the conveyor 6.

The conveyor 6 includes a sheet-feeding roller (paper feed roller) 25 and a sheet-outputting roller (paper discharge roller) 26. The sheet-feeding roller 25 is positioned upstream from the ink-jet head 3 relative to the sheet-feeding direction. The sheet-outputting roller 26 is positioned downstream from the ink-jet head 3 relative to the sheet-feeding direction. The sheet-feeding roller 25 and the sheet-outputting roller 26 are driven and rotated by the sheet-feeding motor 27 and the sheet-outputting motor 28, respectively. The conveyor 6, with the use of the sheet-feeding roller 25, supplies a recording sheet P to the ink-jet head 3 and outputs the recording sheet P having an image or text recorded thereon by the ink-jet head 3, from the sheet-outputting roller 26.

Figure 2:
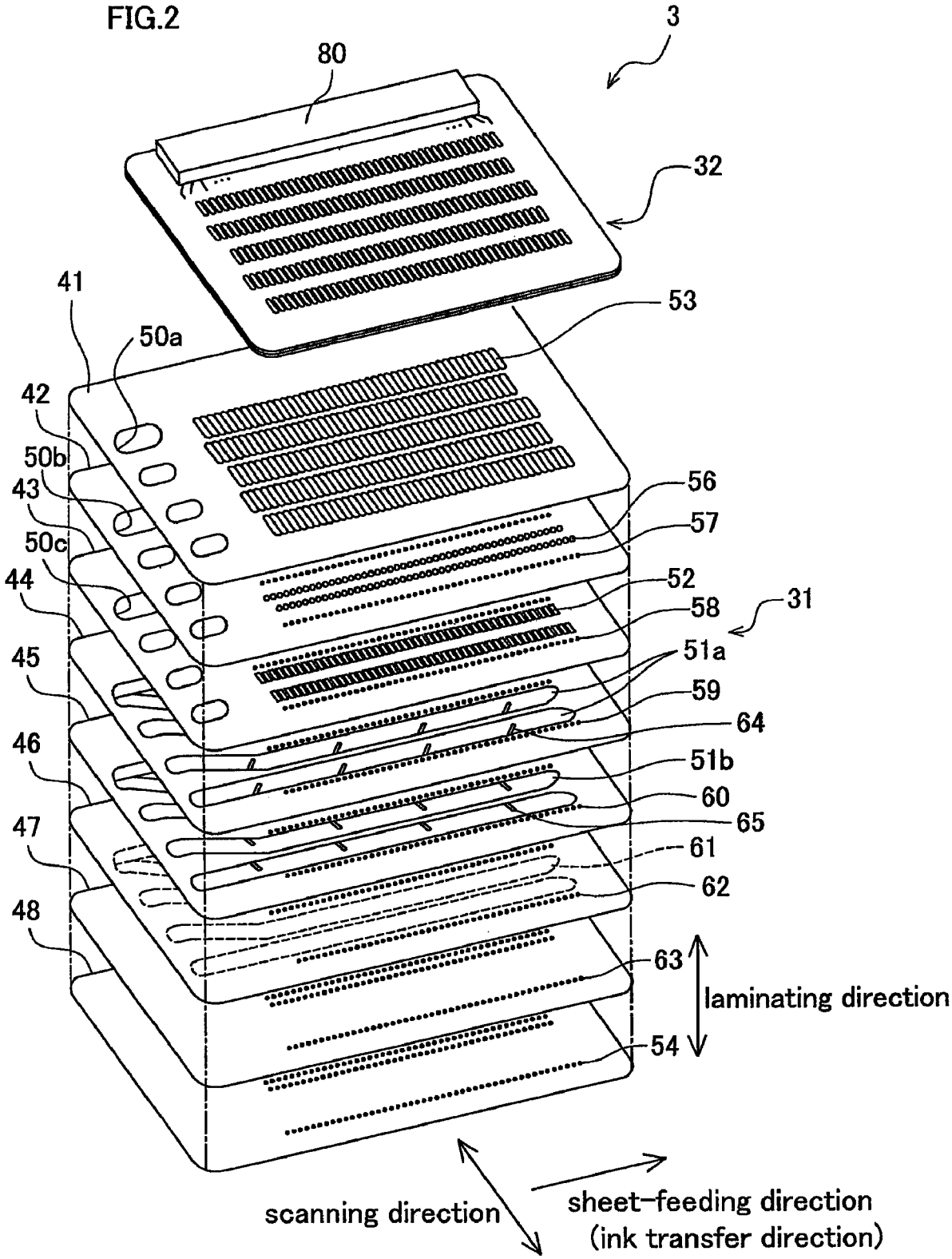
FIG. 2 is an exploded perspective view of the ink-jet head
Figure 3:
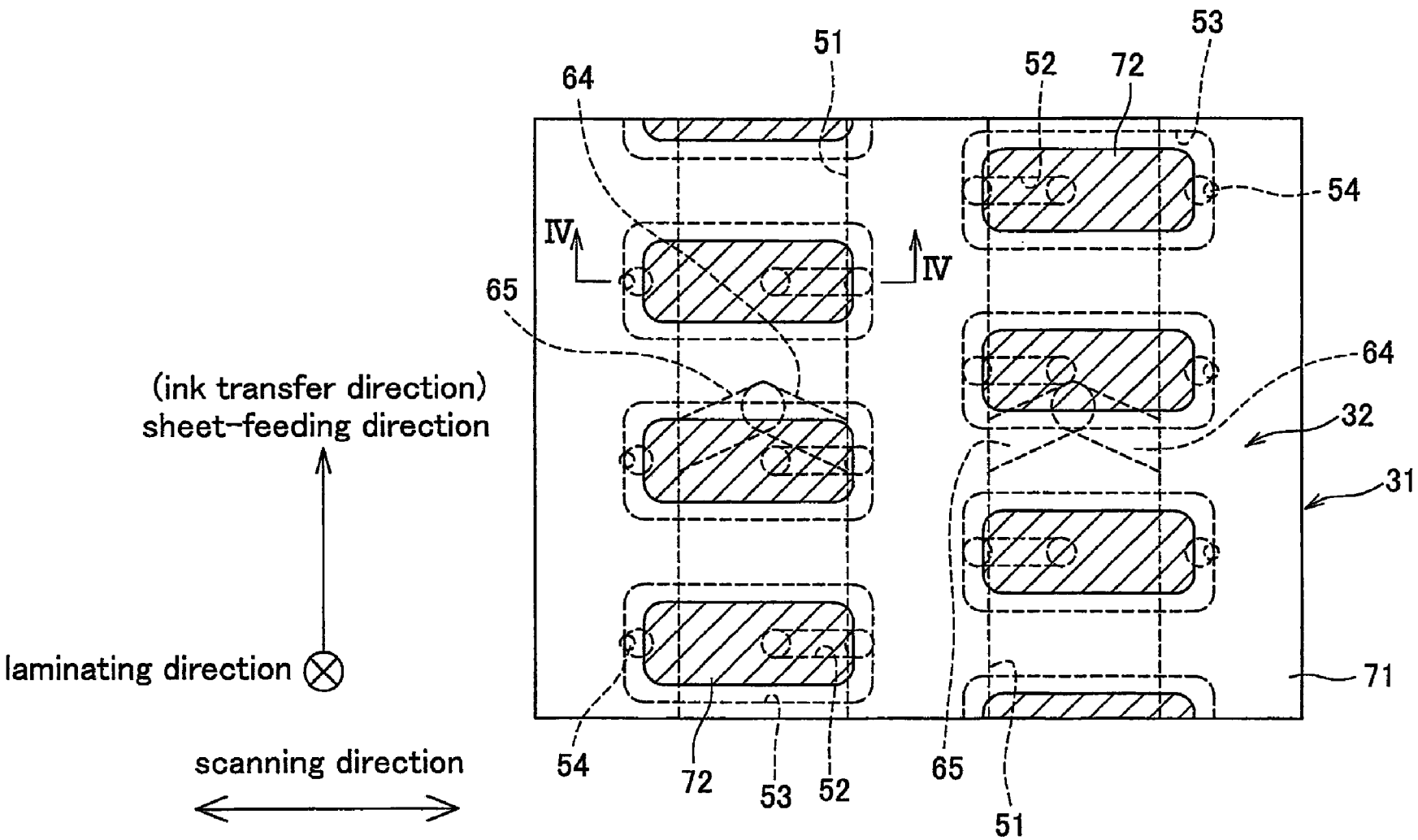
FIG. 3 is a partially enlarged plane view of the ink-jet head.
Figure 4:
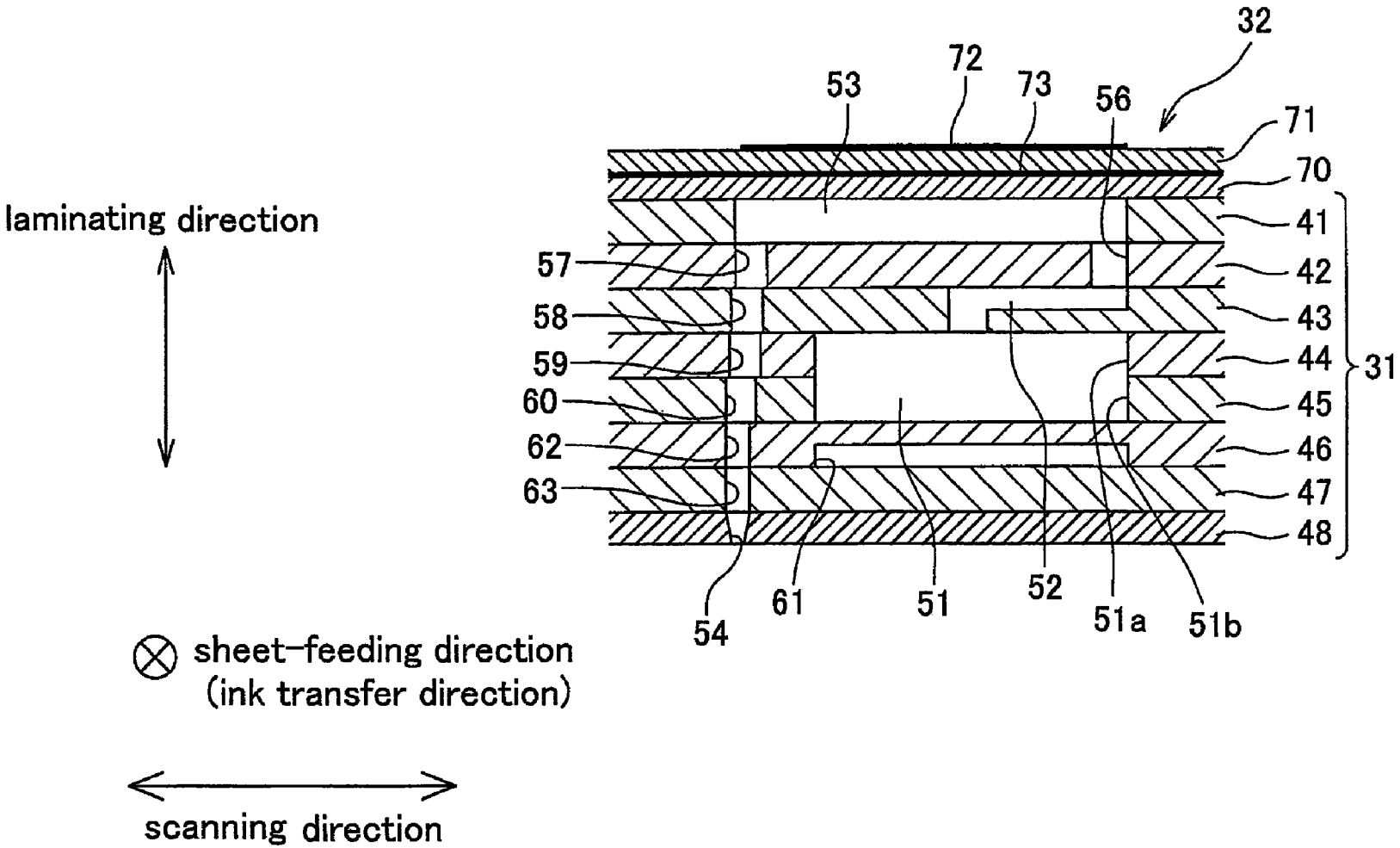
FIG. 4 is a cross sectional view taken along the line IV-IV of FIG. 3.

Next, the following describes the configuration of the ink-jet head 3 with reference to FIGS. 2 to 4. FIG. 2 is an exploded perspective diagram of the ink-jet head 3. FIG. 3 is a partially enlarged plane view of the ink-jet head 3. FIG. 4 is a cross sectional view taken along the line IV-IV of FIG. 3.

As illustrated in FIGS. 2 to 4, the ink-jet head 3 has: a passage unit 31 and a piezoelectric actuator 32. The passage unit 31 has ink passages including a plurality of nozzles 54 and pressure chambers. The piezoelectric actuator 32 is positioned on the top surface of the passage unit 31 and applies energy to inks in the pressure chambers 53 so as to eject the inks from the nozzles 54.

As illustrated in FIG. 2, the passage unit 31 includes a total of eight plates 41 to 48. These eight plates 41 to 48 are a cavity plate 41, a base plate 42, an aperture plate 43, two manifold plates 44 and 45, a dumper plate 46, a cover plate 47, and a nozzle plate 48, and are sequentially laminated and bonded in this order from the top to the bottom. Among these plates 41 to 48, the nozzle plate 48 at the lowermost layer is made of a synthetic resin such as polyimide, and seven other plates 41 to 47 are made of metal such as stainless or nickel steel alloy.

The metal plates 41 to 47 are bonded with one another through metal diffusion bonding, and the nozzle plate 48 made of a synthetic resin is adhered to the cover plate 47 by an adhesive agent.

Among the plates 41 to 48 constituting the passage unit 31, the upper plates 41 to 43 have supply port groups 50*a* to 50*c*, respectively. Each of the supply port groups 50*a* to 50*c* is provided nearby the upstream ends relative to the sheet-feeding direction, and has four supply ports aligned in the scanning direction for receiving inks of four colors supplied from the sub tanks 4*a* to 4*d*, respectively. The plates 44 and 45 from the top have holes 51*a* and 51*b* constituting five manifold channels 51 which extend in the sheet-feeding direction and are positioned side by side relative to the scanning direction (see FIG. 3 and FIG. 4). Thus, in the passage unit 31 are formed manifold channels 51 which receive ink via the supply ports 50*a* to 50*c*, and individual ink passages which branch off from the manifold channels 51 and reach the nozzles 54 via apertures 52 and the pressure chambers 53.

The nozzle plate 48 at the lowermost layer has the nozzles 54 for ejecting ink droplets. The nozzles 54 are aligned in the sheet-feeding direction and form five rows extending in the scanning direction. While there are inks of four colors, there are five rows of nozzles 54. This is because there are two rows of nozzles 54 for ejecting black ink which is most frequently used.

The cavity plate 41 at the uppermost layer has pressure chambers 53 in addition to the above mentioned supply ports 50*a*. These pressure chambers 53 correspond to the nozzles 54, and penetrate the cavity plate 41 in the thickness direction. Each pressure chamber 53 has a plane rectangular shape which is elongated in the scanning direction. The pressure chambers 53 are formed when the cavity plate 41 is sandwiched between the piezoelectric actuator 32 and the base plate 42. The pressure chambers 53 are aligned in the sheet-feeding direction and form five pressure chamber rows arranged in the scanning direction. Of the five pressure chamber rows, two pressure chamber rows are given black ink which is most frequently used, and the other three pressure chamber rows are given inks of yellow, cyan, and magenta, respectively.

The base plate 42 has through holes 56 and 57 in addition to the above mentioned supply ports 50*b*. Each through hole 56 and through hole 57 are in positions corresponding to the two ends of the corresponding one of the pressure chambers 53 in the length direction, and penetrates the base plate 42.

The aperture plate 43 has apertures 52 and through holes 58 in addition to the above mentioned supply ports 50*c*. Each aperture 52 serves as a throttle passage communicating with the corresponding one of the through hole 56. Each through hole 57 serve as a through hole 58 communicating with the corresponding one of the through holes 57. Each aperture 52 extends in the length direction of the pressure chamber 53.

The holes 51*a* on the manifold plate 44 and the holes 51*b* on the manifold plate 45 are arranged and spaced in the scanning direction so as to correspond to the five pressure chamber rows, respectively. By sandwiching the manifold plates 44 and 45 between the aperture plate 43 and the dumper plate 46 in the laminating direction (the direction of laminating plates 41 to 48) so that the holes 51*a* respectively coincide with the holes 51*b*, manifold channels 51 are formed (FIGS. 3 and 4). Of the five manifold channels 51, two manifold channels 51 correspond to the two pressure chamber rows for black ink, and the other three manifold channels 51 respectively correspond to the three pressure chamber rows for inks of the other colors. As illustrated in FIG. 2, the holes 51*a* and 51*b* extend in the sheet-feeding direction so as to overlap with the supply ports 50*c* in the laminating direction, thereby communicating with the supply ports 50*c*.

Further, the manifold plate 44 has through holes 59 communicating with the through holes 58, and the manifold plate 45 has through holes 60 communicating with the through holes 58.

The holes 51*a* on the manifold plate 44 and the holes 51*b* on the manifold plates 45 respectively have first projections 64 and second projections 65 which project inwardly from the side walls defining the holes 51*a* and 51*b*. These first and second projections 64 and 65 are detailed later.

The dumper plate 46 has recesses 61 on its under surface. The recesses 61 are formed by half etching and are positioned so as to overlap with the manifold channels 51 in the laminating direction. The recesses 61 have smaller thickness compared to other parts and serve as a dumper for attenuating pressure variations in the manifold channels 51. The dumper plate 46 further has through holes 62 communicating with the through holes 60. Further, the cover plate 47 has through holes 63 connecting the through holes 62 and the nozzles 54.

Next, the following describes the piezoelectric actuator 32. As illustrated in FIGS. 3 and 4, the piezoelectric actuator 32 has: a diaphragm 70 connected to the top surface of the passage unit 31; a piezoelectric layer 71 laminated on the top surface of the diaphragm 70; individual electrodes 72 corresponding to the pressure chambers 53, which are arranged on the top surface of the piezoelectric layer 71; and a common electrode 73 positioned on the under surface of the piezoelectric layer 71.

The diaphragm 70 and the piezoelectric layer 71 are both made of a piezoelectric material whose main constituent is a ferroelectric lead zirconate titanate for example, and are in the form of sheet having a rectangular plane shape. The diaphragm 70 and the piezoelectric layer 71 are laminated on one another so as to cover all the pressure chambers 53 on the top surface of the passage unit 31. While the piezoelectric layer 71 is polarized in the thickness direction, the diaphragm 70 is not polarized.

As illustrated in FIG. 3, each of the individual electrodes 72 has a rectangular plane shape which is slightly smaller than the pressure chamber 53, and positioned on the top surface of the piezoelectric layer 71 so as to be within an area covered by the corresponding pressure chamber 53 and concentric with the center of the corresponding pressure chamber 53. On the other hand, the common electrode 73 is formed through out the entire surface of the piezoelectric layer 71, between the diaphragm 70 and the piezoelectric layer 71, and faces all the pressure chambers 53 in the laminating direction.

As illustrated in FIG. 2, on the top surface of the piezoelectric layer 71 is mounted a driver IC 80 for driving the piezoelectric actuator 32, according to print data transmitted from a substrate of the printer 1. The driver IC 80 is connected to the individual electrodes 72 via wiring formed on the top surface of the piezoelectric layer 71. From the driver IC 80, a predetermined drive potential or the ground potential is selectively given to the individual electrodes 72. The common electrode 73 is always maintained at the ground potential by connecting the common electrode 73 to the ground wire in the driver IC 80. Note that the driver IC 80 may be connected to the main body of the printer 1, by mounting the driver IC 80 on a flexible printed circuit board (FPC) or the like electrically and mechanically connected to the piezoelectric actuator 32.

An area of the piezoelectric layer 71 facing a pressure chamber 53 in the laminating direction is sandwiched between the corresponding individual electrode 72 and the common electrode 73. Thus, when a predetermined drive potential is applied to the individual electrode 72, the piezoelectric layer 71 serves as an active layer in which piezoelectric strain takes place in response to application of an electric field in the thickness direction. On the other hand, the diaphragm 70 is an inactive layer in which no piezoelectric strain takes place, although the diaphragm 70 is also made of a piezoelectric material. This is because the diaphragm 70 is not sandwiched between the individual electrode 72 and the common electrode 73.

The following describes an operation of the piezoelectric actuator 32 at the time of ink ejection. When the driver IC 80 applies a drive potential to the individual electrode 72, there will be a difference in the potentials of the individual electrode 72 and the common electrode 73, and an electric field in the thickness direction is applied to a portion of the piezoelectric layer 71 sandwiched between the electrodes 72 and 73. The direction of the electric field is parallel to the polarization direction of the piezoelectric layer 71, and therefore the portion to which the electric field is applied expands and contracts in the thickness direction. On the other hand, the diaphragm 70 which is the inactive layer is fixed on the cavity plate 41. Therefore, with the contraction of the piezoelectric layer 71 in an in-plane direction, the area of the piezoelectric layer 71 facing the pressure chamber 53 deforms and projects towards the pressure chamber 53 (unimorph deformation). With this deformation, the capacity of the pressure chamber 53 decreases. The decrease in the capacity of the pressure chamber 53 applies a pressure to the ink in the pressure chamber 53. As a result, ink droplets are ejected from the nozzles 54 communicated with the pressure chamber 53.

Figure 5:
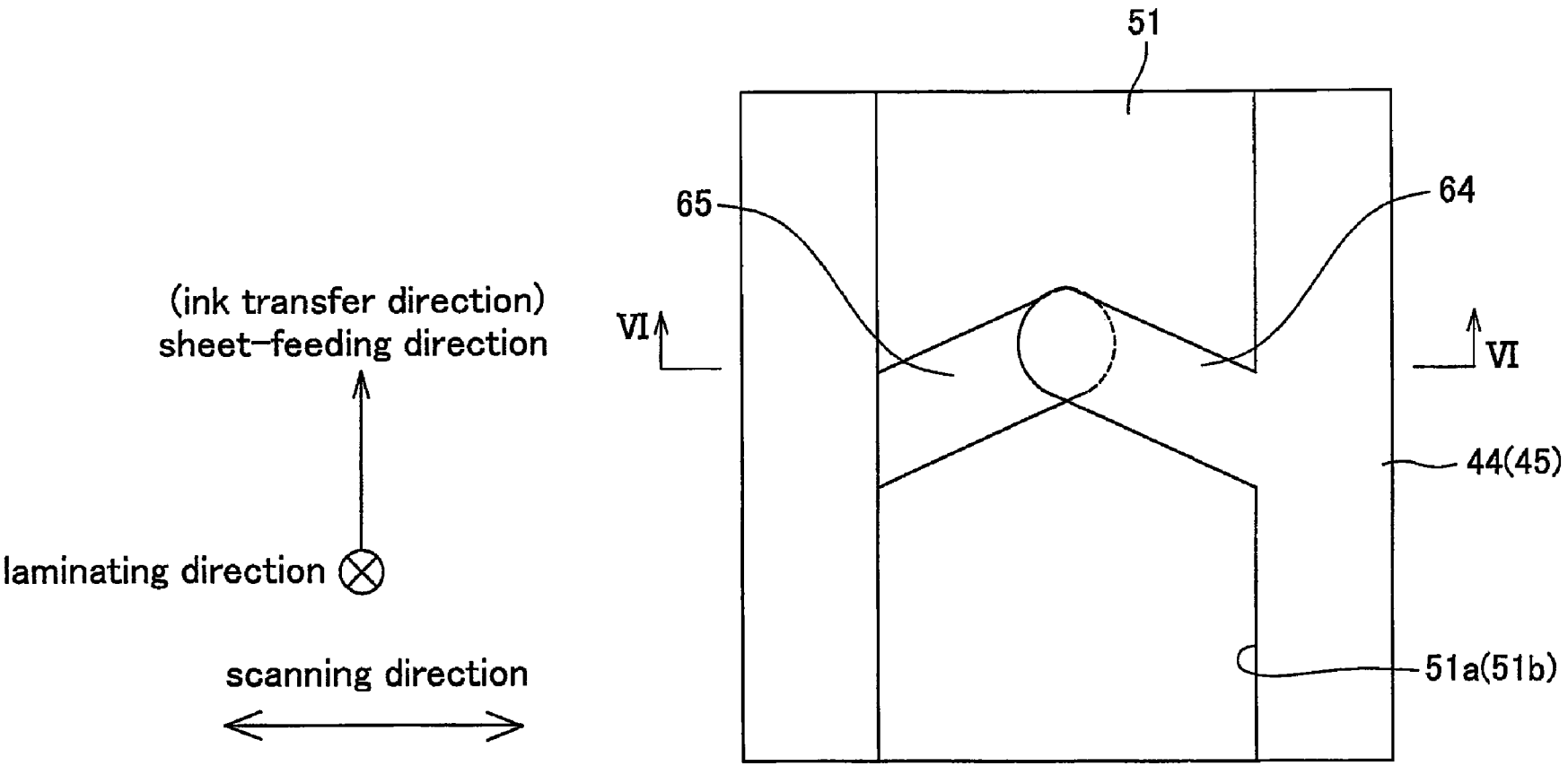
FIG. 5 is a partially enlarged top view of two manifold plates laminated on each other.
Figure 6:
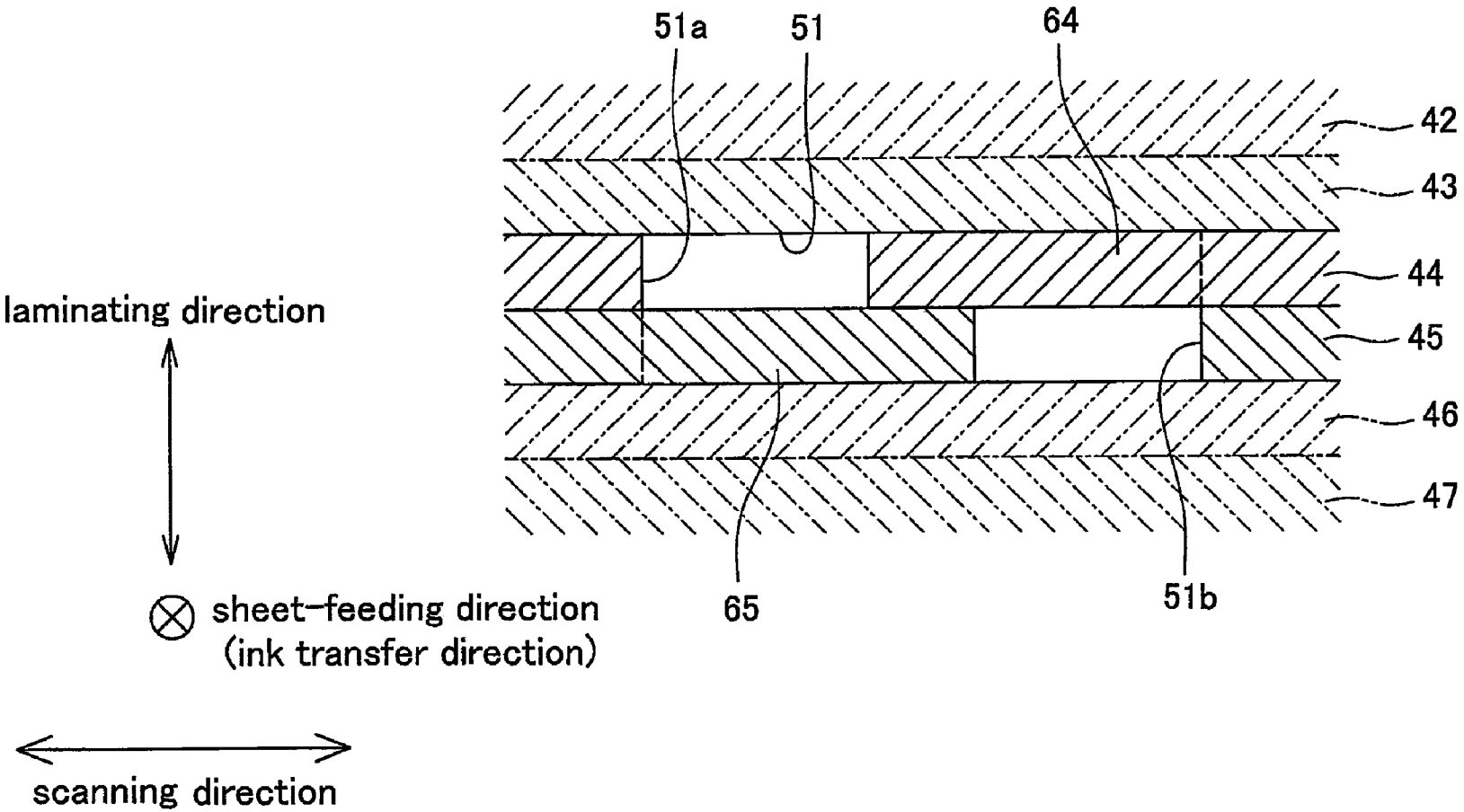
FIG. 6 is a cross sectional view taken along the line VI-VI of FIG. 5.

Next, the following describes the first and second projections 64 and 65 respectively formed on the manifold plates 44 and 45, with reference to FIGS. 2, 3, 5, and 6. FIG. 5 is a partially enlarged top view of the manifold plates 44 and 45 laminated on each other. FIG. 6 is a cross sectional view taken along the line VI-VI of FIG. 5.

Each hole 51*a* on the manifold plate 44 has four first projections 64 arranged at a certain interval in the sheet-feeding direction: i.e. the length direction of the hole 51*a*. Each first projection 64 projects in an in-plane direction of the plate 44, towards inside of the hole 51*a*, from the side wall (on the side closer to the viewer of FIG. 2) defining the hole 51*a*. Each hole 51*b* on the manifold plate 45 has four second projections 65 arranged at a certain interval in the sheet-feeding direction: i.e. the length direction of the hole 51*a*, as in the case of each hole 51*a*. Each second projection 65 projects in an in-plane direction of the plate 45, towards inside of the hole 51*b*, from the side wall (on the side far from the viewer of FIG. 2) defining the hole 51*b*.

As illustrated in FIGS. 5 and 6, the first projection 64 extends from the side wall (on the right side of the FIGS. 5 and 6) defining the hole 51*a* to a point slightly beyond the middle of the hole 51*a* in the width direction, and is slanted towards the downstream of the ink transfer direction. The width direction of the hole 51*a* is a direction orthogonal to the sheet-feeding direction which is the length direction of the hole 51*a*, and is the same direction as the scanning direction. Further, the ink transfer direction is a direction of transferring ink in the manifold channels 51. More specifically, the ink transfer direction is a direction in which ink flows in a manifold channel 51, when the ink is supplied from the supply ports 50*a* to 50*c* to the manifold passage 51 and branches into the pressure chambers 53. The ink transfer direction is the same direction as the sheet-feeding direction, and the upstream and downstream of the ink transfer direction are the left and right sides of FIG. 2, respectively.

The second projection 65 extends from the side wall (on the left side of the FIGS. 5 and 6) defining the hole 51*b* to a point slightly beyond the middle of the hole 51*b* in the width direction, and is slanted towards the downstream of the ink transfer direction. The width direction of the hole 51*b* is the same as the width direction of the hole 51*a*, and corresponds to the width direction of the manifold channel 51. The first and second projections 64 and 65 project respectively from one and the other side of the side walls defining the holes 51*a* and 51*b*, relative to the width direction.

As mentioned above, each pair of first and second projections 64 and 65 are continuous from one end of the manifold channel 51 to the other end thereof, in the laminating direction as illustrated in FIG. 6. Therefore, when a pressure is applied to the plates 41 to 47 in the laminating direction to bond the plates 41 to 47, each pair of first and second projections 64 and 65 supports portions of plates 41 to 43, 46 and 47 other than the manifold plate 44 and 45, which portions face the pair of first and second projections 64 and 65 in the laminating direction. In other words, the pressure applied is also applied and dispersed to these portions of the plates 41 to 43, 46 and 47 through the first and second projections 64 and 65. This restrains deformation of the side walls defining the holes 51*a* and 51*b*. Further, the problem of poor bonding among the plates, which is attributed to the deformation of the side walls, is restrained. Further, the pressure applied is easily transferred to the entire plates 41 to 47 through the first and second projections 64 and 65. This ensures favorable bonding of the plates, even in the case of metal diffusion bonding.

Further, as illustrated in FIG. 6, the first and second projections 64 and 65 ensure spaces of the manifold channels 51 in the laminating direction, below the first projections 64 and above the second projections 65. Therefore, the cross sectional areas of the manifold channels 51 in the laminating direction are not largely reduced by the presence of the first and second projections 64 and 65. Thus, an increase in the passage resistance of the manifold channels 51 is restrained as much as possible.

As illustrated in FIG. 2, the number of first projections 64 throughout the length direction of a single hole 51*a* is not one, and each hole 51*a* has four first projections 64 spaced from one another in the length direction. Likewise, as illustrated in FIG. 2, the number of second projections 65 throughout the length direction of a single hole 51*b* is not one, and each hole 51*b* has four second projections 64 spaced from one another in the length direction. Thus, the capacity of the manifold channel 51 is not significantly reduced by the presence of the first and second projections 64 and 65. The first projections 64 spaced from one another in the length direction of the hole 51*a* and the second projections 65 spaced in the length direction of the hole 51*b* disperses a pressure applied at the time of bonding the plates in a wider range. This efficiently improves the above mentioned effects, i.e. the effect of restraining deformation of the side walls, and the effect of realizing a favorable bonding among the plates.

Further, as illustrated in FIG. 6, the laminating directional cross section of a portion of a manifold channel 51 having the first and second projections 64 and 65 has a shape which is point symmetrical with respect to the center of the cross section. Therefore, a flow of ink in the manifold channel 51 is likely to be point symmetrical with respect to the center, and occurrence of drift current in the manifold channel 51 is restrained. Further, since the pressure applied at the time of bonding the plates is easily and evenly dispersed to the entire plates, the above mentioned effects, i.e. the effect of restraining deformation of the side walls, and the effect of realizing a favorable bonding among the plates are improved.

The first projections 64 project from side walls defining the holes 51*a* on the manifold plate 44, and the second projections 65 project from the side walls defining the holes 51*b* on the manifold plate 45. That is, the first and second projections 64 and 65 are formed on the different plates 44 and 45. Projections are easily formed in this case, compared to a case of providing to a single plate a continuous projection which ensures a space of a manifold channel 51 in the laminating direction, e.g., forming a projection whose thickness is a half the thickness of the plate to which the projection is formed.

As illustrated in FIGS. 5 and 6, the tips of the first and second projections 64 and 65 contact each other. In this manner, the simple form of projections 64 and 65 support the plates other than the manifold plates 44 and 45, i.e., plates 41 to 43, 46, and 47 in the laminating direction, thereby restraining deformation of the side walls.

As illustrated in FIG. 5, each of the first projections 64 projects from one side of the side wall defining the hole 51*a* relative to the width direction, and the corresponding one of the second projections 65 projects from the other side of the side wall defining the hole 51*b* relative to the width direction so as to contact that corresponding first projection 64. This ensures the rigidity of the side wall without fail, and deformation attributed to pressure applied to the side wall is restrained without fail.

The first and second projections 64 and 65 contact each other at the middle of the holes 51*a* and 51*b* in the width direction. Therefore, the pressure applied at the time of bonding the plates is evenly dispersed in the width direction. This efficiently improves the above mentioned effects, i.e. the effect of restraining deformation of the side walls, and the effect of realizing a favorable bonding among the plates.

The first and second projections 64 and 65 are slanted towards downstream in the ink transfer direction. Thus, the first and second projections 64 and 65 hardly disturb the flow of ink in the manifold channel 51, and an increase in the passage resistance of the manifold channel 51 is restrained. As a result, the ink flows smoothly in the manifold channel 51.

When performing metal diffusion bonding, a considerably high pressure is applied to the plates, unlike the case of bonding plates by adhesives or the like. However, the first and second projections 64 and 65 support the plates 41 to 43, 46, and 47. Therefore, deformation in the side walls defining the holes 51*a* and 51*b* is restrained even at the time of subjecting the plates 41 to 47 to metal diffusion bonding. This realizes favorable bonding among the plates.

The first and second projections 64 and 65 also restrain so-called fluidic crosstalk. Fluidic crosstalk is a phenomena in which a pressure applied to ink in a pressure chamber 53 by driving a piezoelectric actuator 32 generates a pressure wave in that pressure chamber 53, and the pressure chamber propagates to an adjacent pressure chamber 53 through the manifold channel 51. When this fluidic crosstalk occurs, the characteristic of ejecting ink droplets from the nozzle 54 varies due to the pressure wave. This problem however is restrained with the provision of the first and second projections 64 and 65.

More specifically, as illustrated in FIG. 6, the cross section of the manifold channel 51 in the laminating direction is locally reduced at a portion where the first and second projections 64 and 65 are provided. Therefore, pressure waves propagated from one pressure chamber 53 to the manifold channel 51 partially reflect on the second projections 64 and 65. The reflected wave interferes with the rest of the pressure waves, and thus the pressure waves as a whole is attenuated in the manifold channel 51. As a result, the propagation of pressure waves to an adjacent pressure chamber 53 through the manifold channel 51 is restrained.

Next, a method of manufacturing the ink-jet head 3 is described with reference to FIGS. 7A, 7B, and FIGS. 8A to 8C. In the present embodiment, the passage unit 31 and the piezoelectric actuator 32 are separately manufactured. Then, the piezoelectric actuator 32 is adhered on the top surface of the passage unit 31 to manufacture the ink-jet head 3.

Figure 8A:
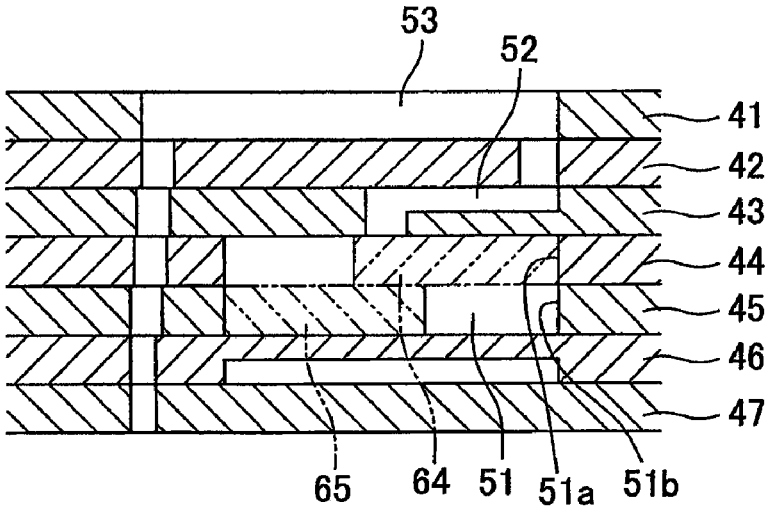
FIG. 8A is a diagram illustrating a laminating process in the process of manufacturing the passage unit.
Figure 8B:
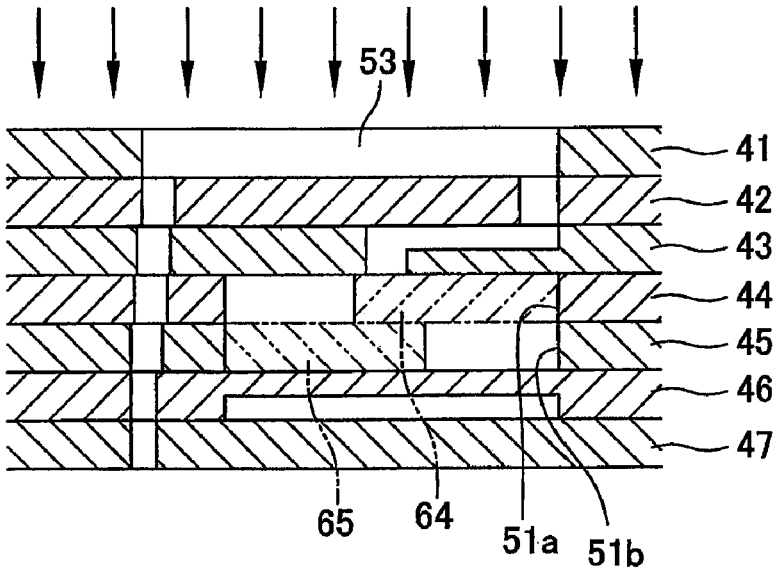
FIG. 8B is a diagram illustrating a jointing process in the process of manufacturing the passage unit.
Figure 8C:
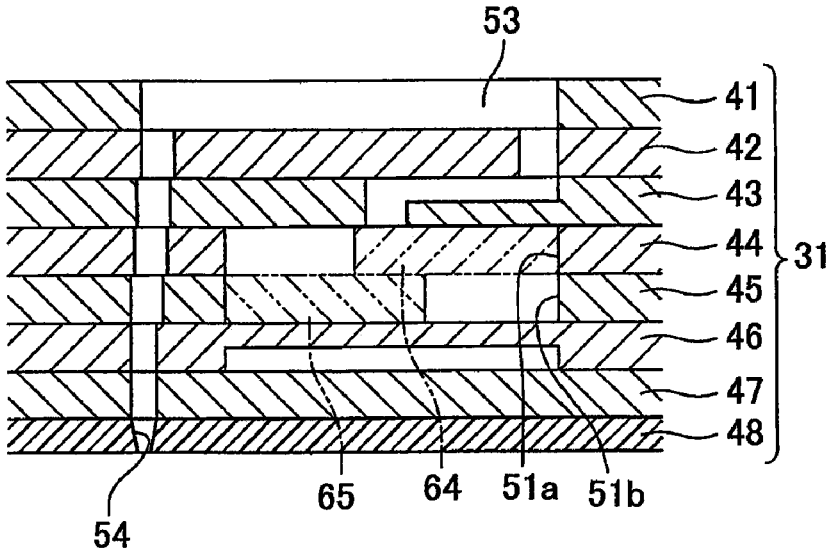
FIG. 8C is a diagram illustrating a process of adhering nozzle plates in the process of manufacturing the passage unit.

First described is manufacturing of the passage unit 31 with reference to mainly FIGS. 8A to 8C. First, holes constituting the ink passage, i.e. nozzles 54, pressure chambers 53, apertures 52, manifold channels 51, or the like are formed on eight plates 41 to 48 constituting the passage unit 31 (hole formation step).

On the nozzle plate 48 are formed holes constituting nozzles 54 by lasering or the like. On the other plates 41 to 47 are formed by etching or the like holes constituting pressure chambers 53, apertures 52, manifold channels 51, or the like. At this time, the holes 51*a* and 51*b*, and the first and second projections 64 and 65 are formed on the manifold plates 44 and 45 at the same time.

Next, as illustrated in FIG. 8A, the plates 41 to 47 are positioned using positioning marks (not shown) and are laminated on each other so as to form therein manifold channels 51 and a plurality of individual ink passages (laminating process). The manifold plates 44 and 45 are laminated so that the tips of the first projections 64 contact and become continuous with the tips of corresponding second projections 65 while ensuring a space in the laminating direction for manifold channels 51.

Then, as illustrated in FIG. 8B, the plates 41 to 47 having been laminated on one another are subjected to metal diffusion bonding (bonding step). Specifically, a pressure is applied to the plates 41 to 47 in the laminating direction under a high-temperature condition (e.g. approximately 1000 deg. C.), so as to bond the plates 41 to 47 by dispersing metal atoms among the plates 41 to 47.

In this step, the plates 41 to 47 need to be subjected to a considerably high pressure to cause dispersion of metal atoms among the plates 41 to 47. In the present embodiment however, the first and second projections 64 and 65 support the portions of the plates 41 to 43, 46, and 47 facing the first and second projections 64 and 65 in the laminating direction. Therefore, the side walls defining the holes 51*a* and 51*b* are restrained from being deformed, and the problem of poor bonding among the plates attributed to the deformation is restrained. Further, the pressure applied easily propagates to the entire plates 41 to 47 through the first and second projections 64 and 65. It is therefore possible to realize a favorable bonding among the plates even if the plates are bonded with one another by metal diffusion bonding.

Next, as illustrated in FIG. 8C, the nozzle plate 48 is bonded, by using an adhesive, with the under surface of the lamination of the plates 41 to 47 obtained from the bonding step, i.e., with the under surface of the cover plate 47. Thus, the passage unit 31 including a total of eight plates 41 to 48 is completed.

Figure 7A:
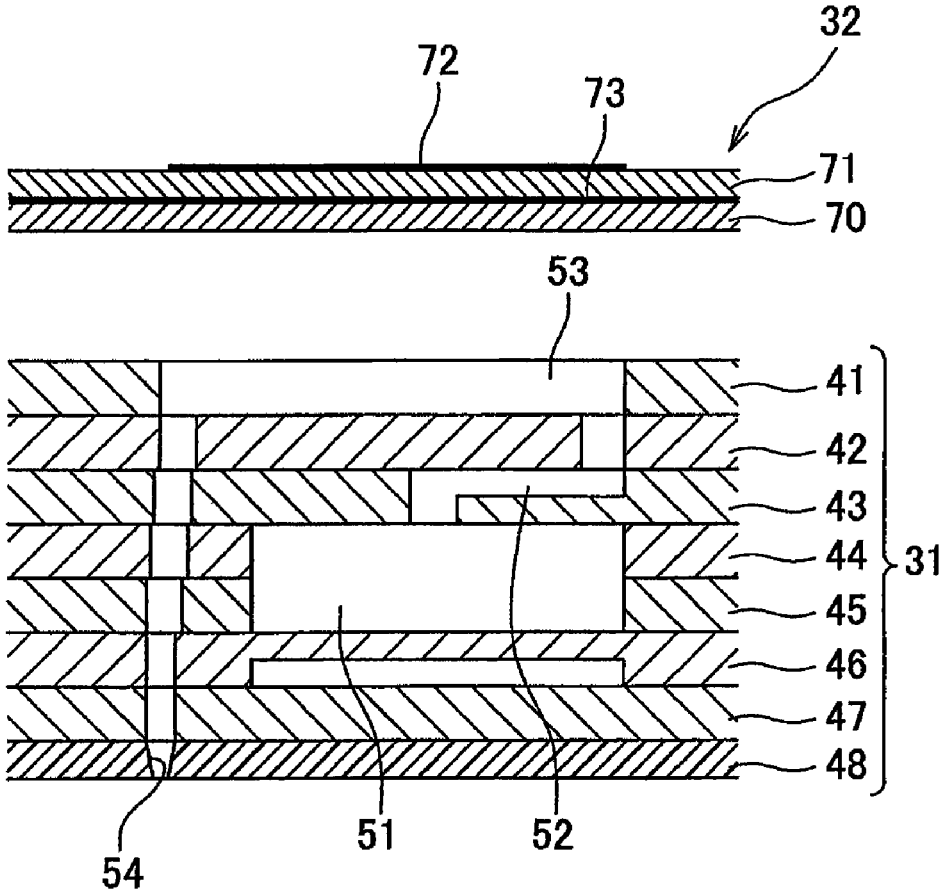
FIG. 7A is a diagram illustrating a passage unit and a piezoelectric actuator, before these members are adhered to each other in a manufacturing process of the ink-jet head.

Next, the following describes the steps of manufacturing the piezoelectric actuator 32. First, two non-calcinated green sheets to form the diaphragm 70 and the piezoelectric layer 71 are prepared. One of the green sheets to form the piezoelectric layer 71 is then subjected to a screen printing or the like to form a plurality of individual electrodes 72 on one surface of that one green sheet and a common electrode 73 on the other surface of the same. Then, as illustrated in FIG. 7A, the two green sheets are overlapped with one another so as to interpose the common electrode 73 therebetween, and are calcinated at high temperatures. Thus, the piezoelectric actuator 32 is completed.

Figure 7B:
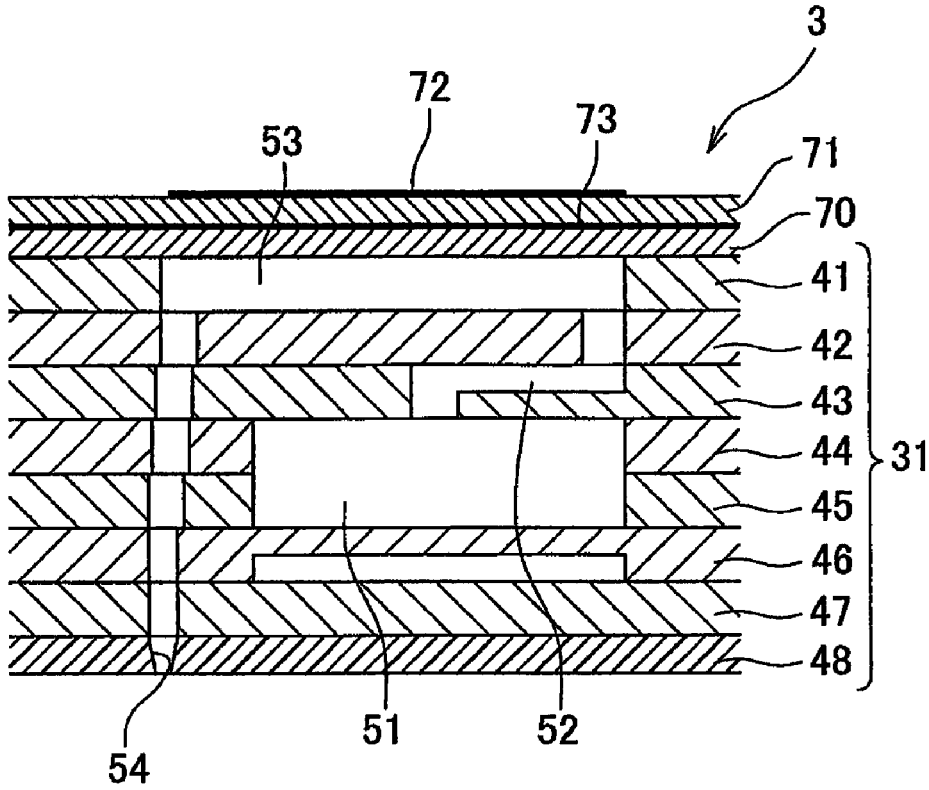
FIG. 7B is a diagram illustrating the passage unit and the piezoelectric actuator after these members are adhered to each other.

Then, as illustrated in FIG. 7B, the piezoelectric actuator 32 is bonded by using an adhesive with the top surface of the cavity plate 41 of the passage unit 31. Thus, the ink-jet head 3 including the passage unit 31 and the piezoelectric actuator 32 is completed.

Next, the following describes alternative examples which are obtained by various modifications of the ink-jet head of the above described embodiment. The same reference numbers are given to members similar to those described in the foregoing embodiment, and explanation thereof are omitted in the following.

Figure 9:
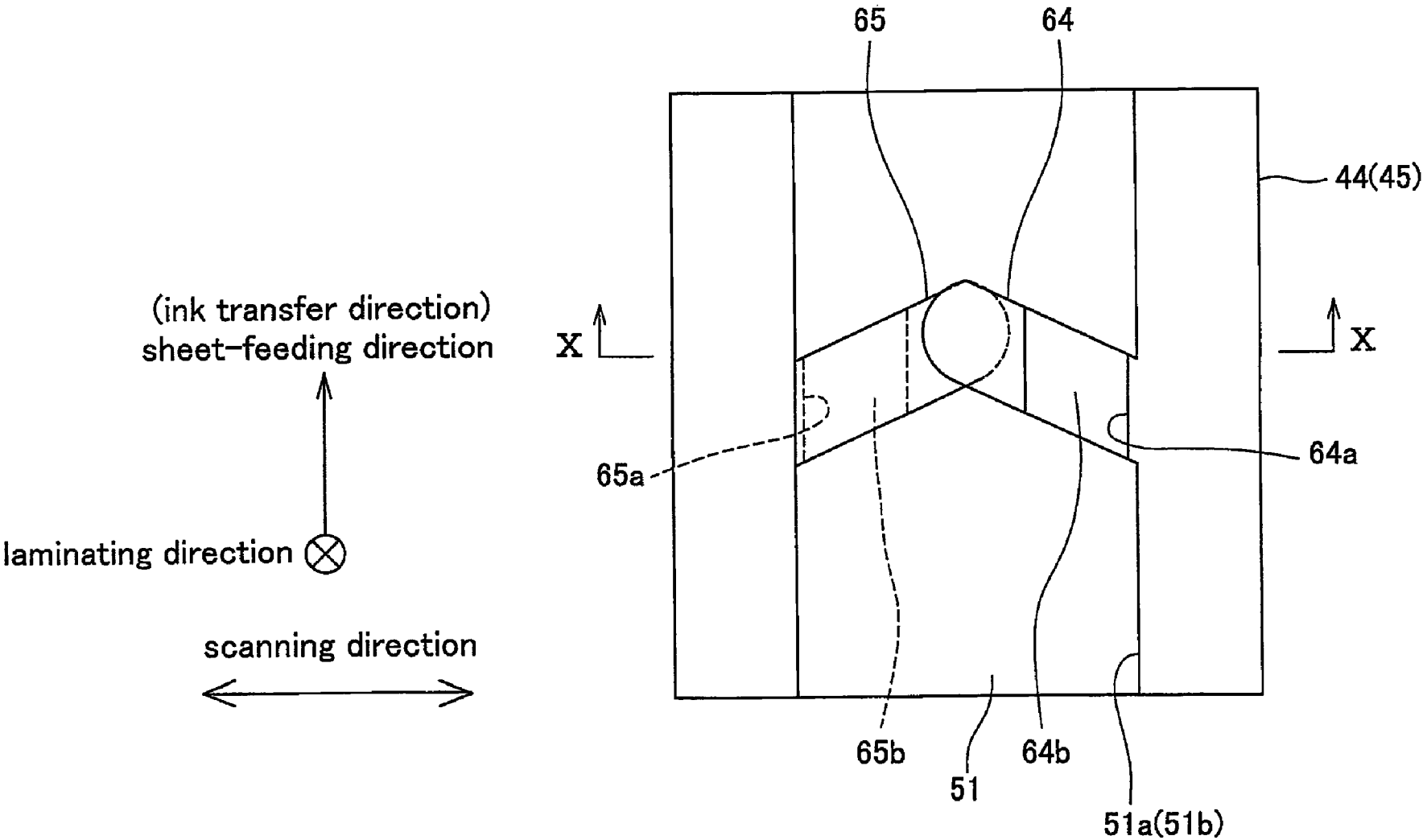
FIG. 9 is a partially enlarged top view of the manifold plate in the ink-jet head of a first alternative example.
Figure 10:
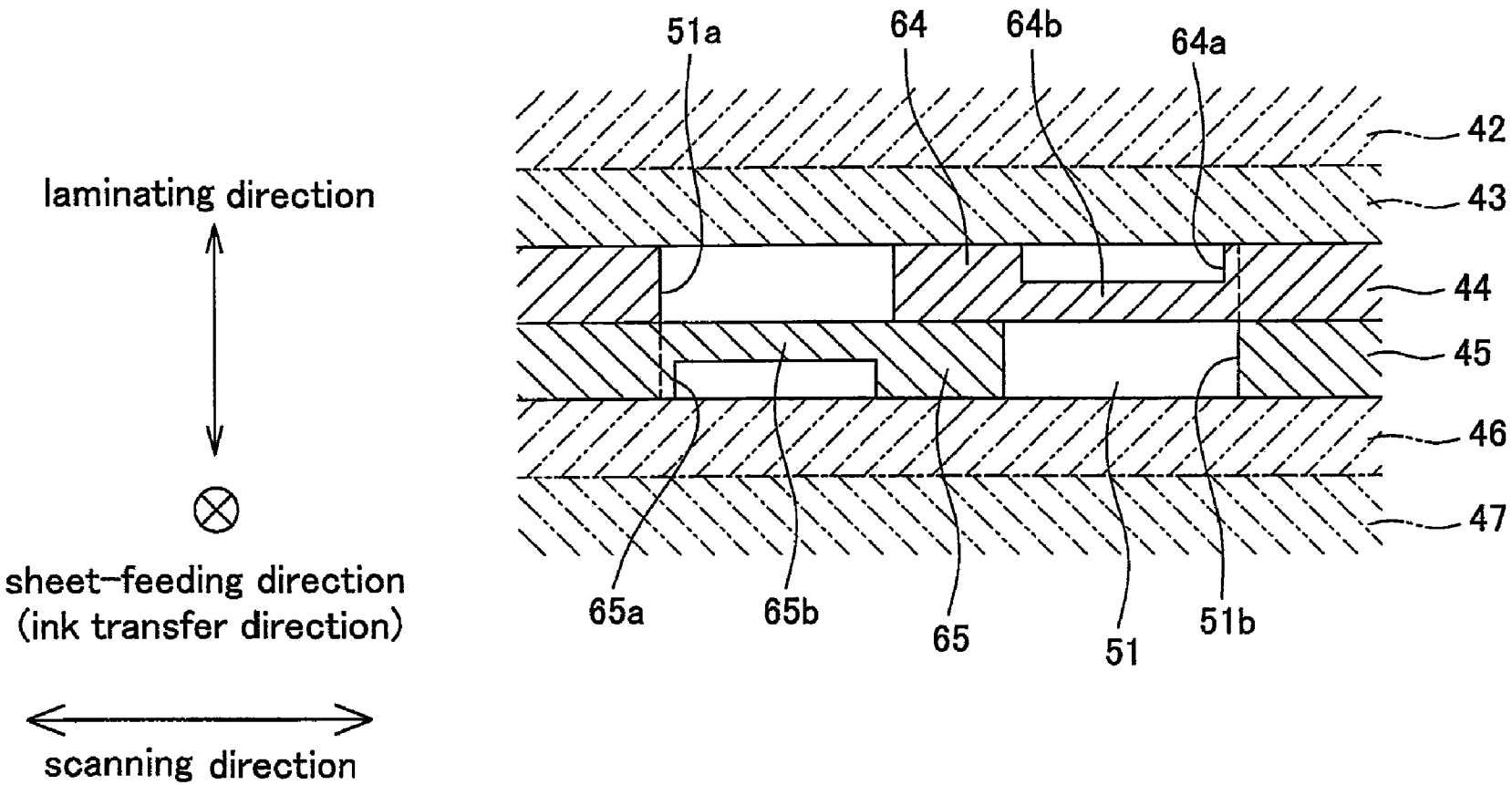
FIG. 10 is a cross sectional view taken along the line X-X of FIG. 9.

First described is a first alternative example, with reference to FIG. 9 and FIG. 10. In the ink-jet head of the present alternative example, each first projection 64 is provided with a recess 64*a* on its top surface, and each second projection 65 is provided with a recess 65*a* on its under surface. The recesses 64*a* and 65*a* are part of the manifold channel 51, and ink flows into individual ink passages through the recesses 64*a* and 65*a*. The bottoms of the recesses 64*a* and 65*a* are thinner portions 64*b* and 65*b* which is thinner than the tips of the first and second projections 64 and 65. The recess 64*a* is formed on the entire width direction of the first projection 64 except for the portion contacting the second projection 65. Likewise, the recess 65*a* is formed on the entire width direction of the second projection 65 except for the portion contacting the first projection 64. With the present alternative example, the cross section area of the manifold channel 51 in the laminating direction is larger than that in the foregoing embodiment by an amount of the space ensured by the recesses 64*a* and 65*a*. Therefore, an increase in the passage resistance of the manifold channel 51 is more effectively restrained.

Figure 11:
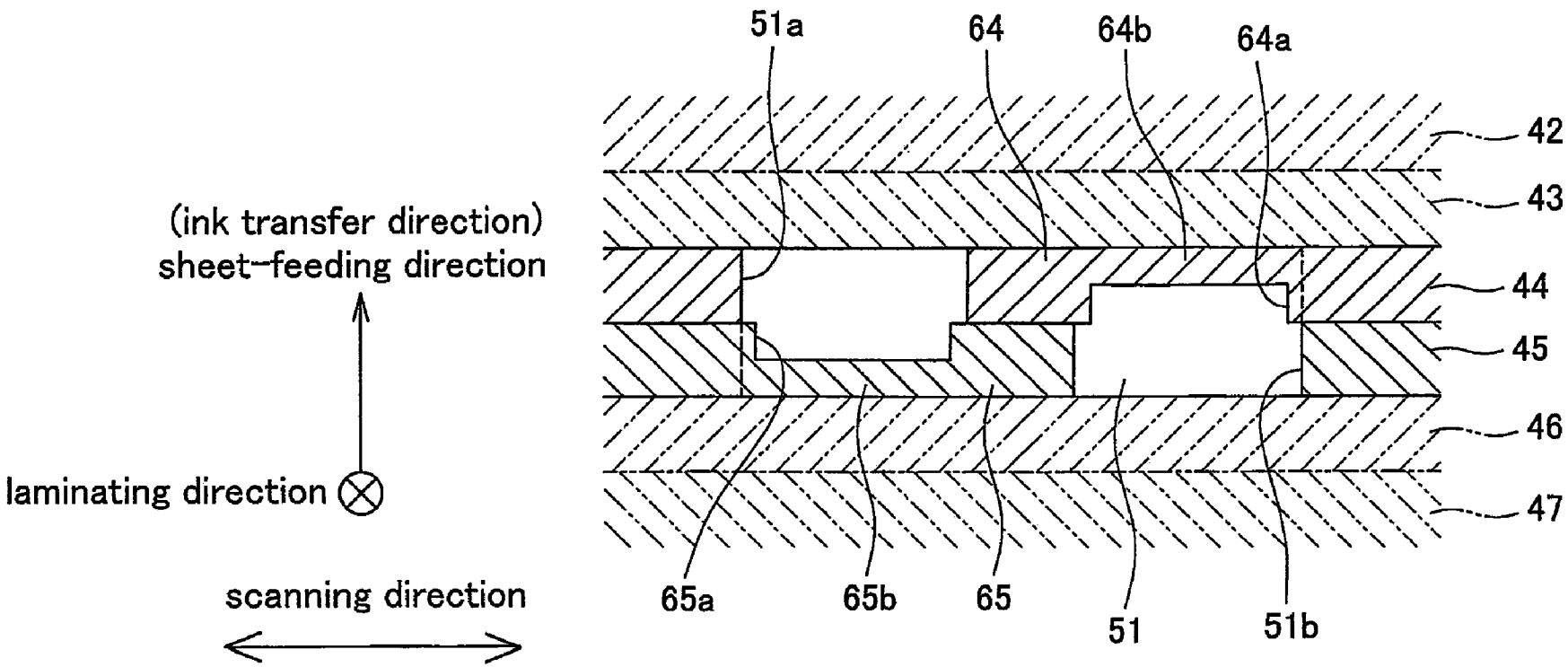
FIG. 11 is a cross sectional view equivalent to FIG. 10, and illustrates manifold plates in an ink-jet head of a second alternative example.

FIG. 11 shows a second alternative example. In the first alternative example described with reference to FIG. 10, the recess 64*a* is formed on the surface of the first projection 64 which surface is opposite of the surface contacting the second projection 65, and the recess 65*a* is formed on the surface of the second projection 65 which surface is opposite of the surface contacting the first projection 64. In the present alternative example however, the first projection 65 is provided with a recess 64*a* on its surface contacting the second projection 65, and the second projection 65 is provided with a recess 65*a* on its surface contacting the first projection 64. In other words, the first projection 64 is provided with the recess 64*a* on its under surface, and the second projection 65 is provided with the recess 65*a* on its top surface. This alternative example also restrains an increase in the passage resistance of the manifold channel 51, as in the case of the first alternative example.

Figure 12:
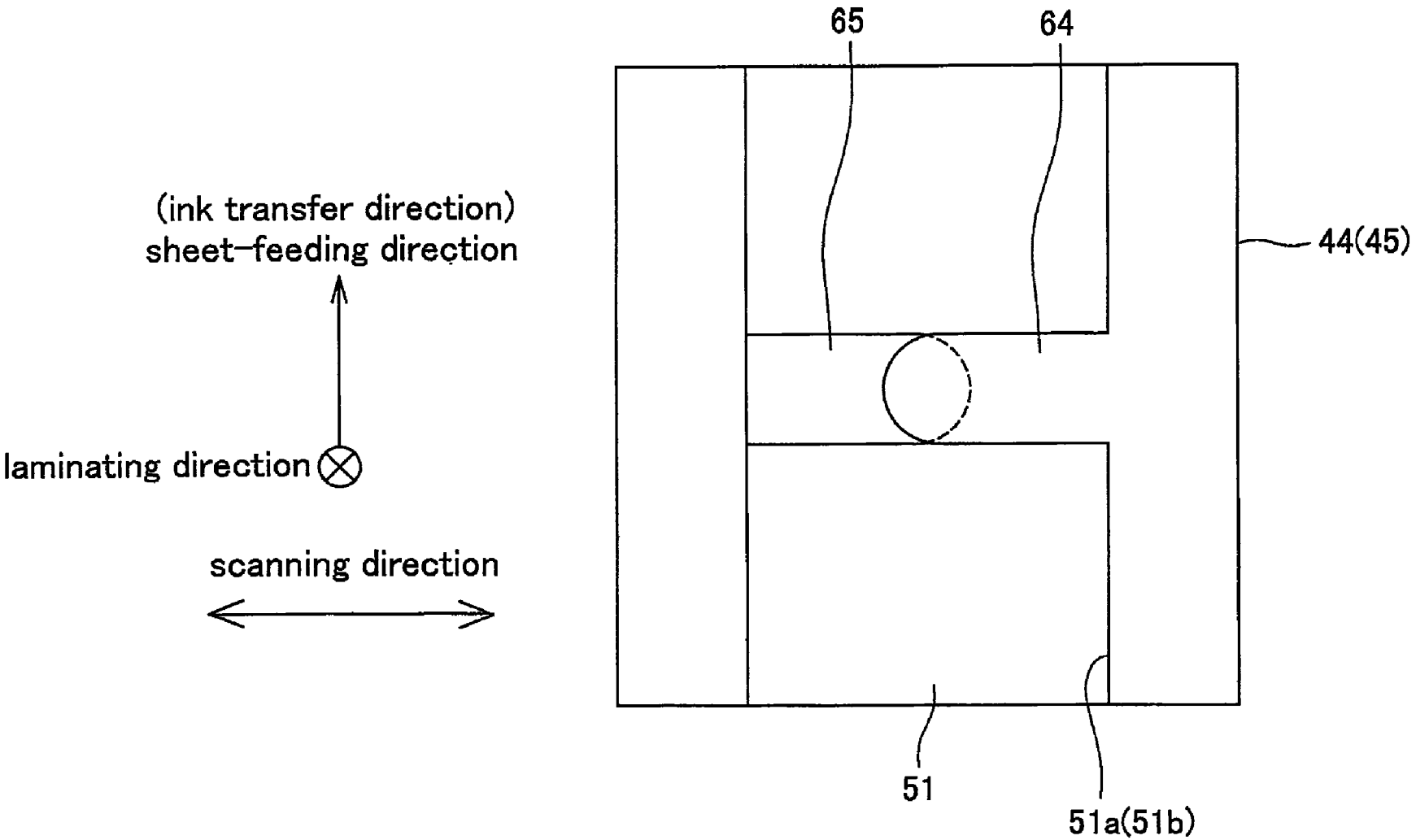
FIG. 12 is a partially enlarged top view of manifold plate in an ink-jet head of a third alternative example.

FIG. 12 illustrates a third alternative example. In an ink-jet head of the present alternative example, the first and second projections 64 and 65 extends in the width direction of the holes 51*a* and 51*b*. As in the foregoing embodiment, the present alternative example also brings about an effect that a flow of ink in the manifold channel 51 is likely to be point symmetrical with respect to the center of the cross section of the passage 51, and occurrence of drift current in the manifold channel 51 is restrained.

Figure 13:
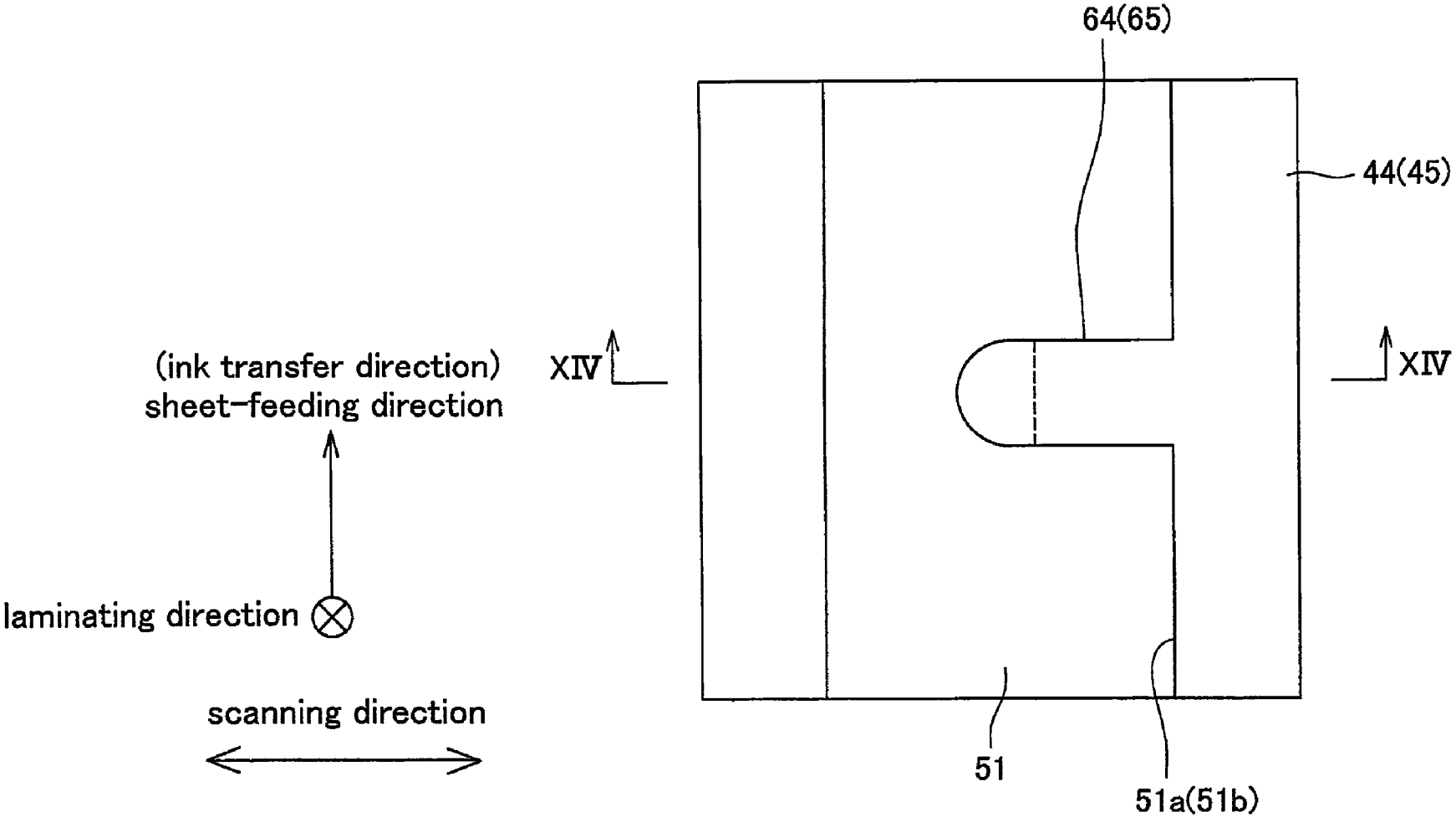
FIG. 13 is a partially enlarged top view of manifold plates in an ink-jet head of a fourth alternative example.
Figure 14:
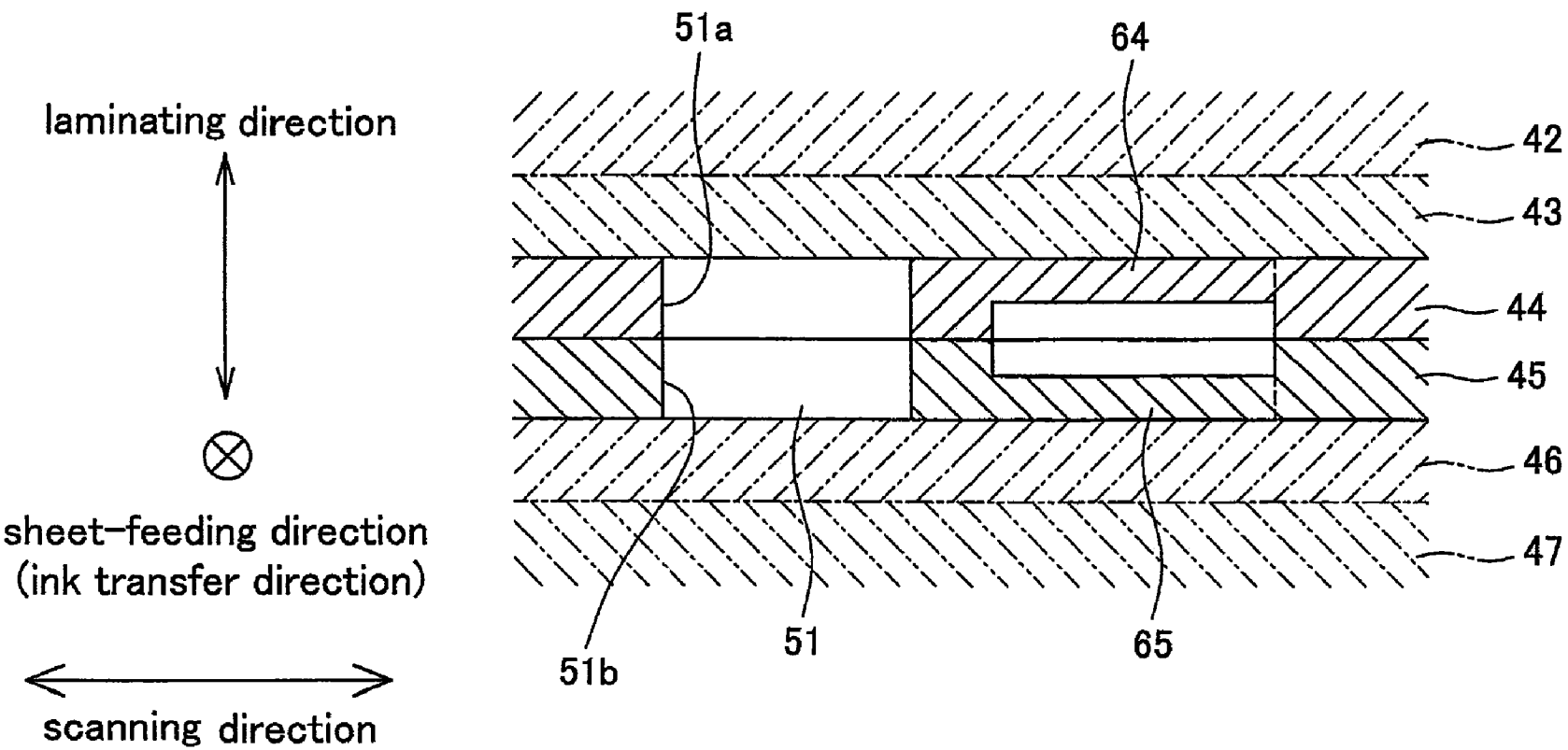
FIG. 14 is a cross sectional view taken along the line XIV-XIV of FIG. 13.

FIGS. 13 and 14 illustrate a fourth alternative example. In an ink-jet head of the present alternative example, the first and second projections 64 and 65 project from the side walls on the same side relative to the width direction, unlike the foregoing embodiment in which the first and second projections 64 and 65 project from one and the other side of the side walls. These first and second projections 64 and 65 face each other in the laminating direction as illustrated in FIG. 14. The first projection 64 has a recess on its under surface and the second projection has a recess on its top surface, so that only the tips of the first and second projections contact each other, and the rest of the first and second projections are apart from each other. The portions of the first and second projections 64 and 65 apart from each other, i.e., the recesses on the first and second projections 64 and 65 form a part of the manifold channel 51.

Figure 15:
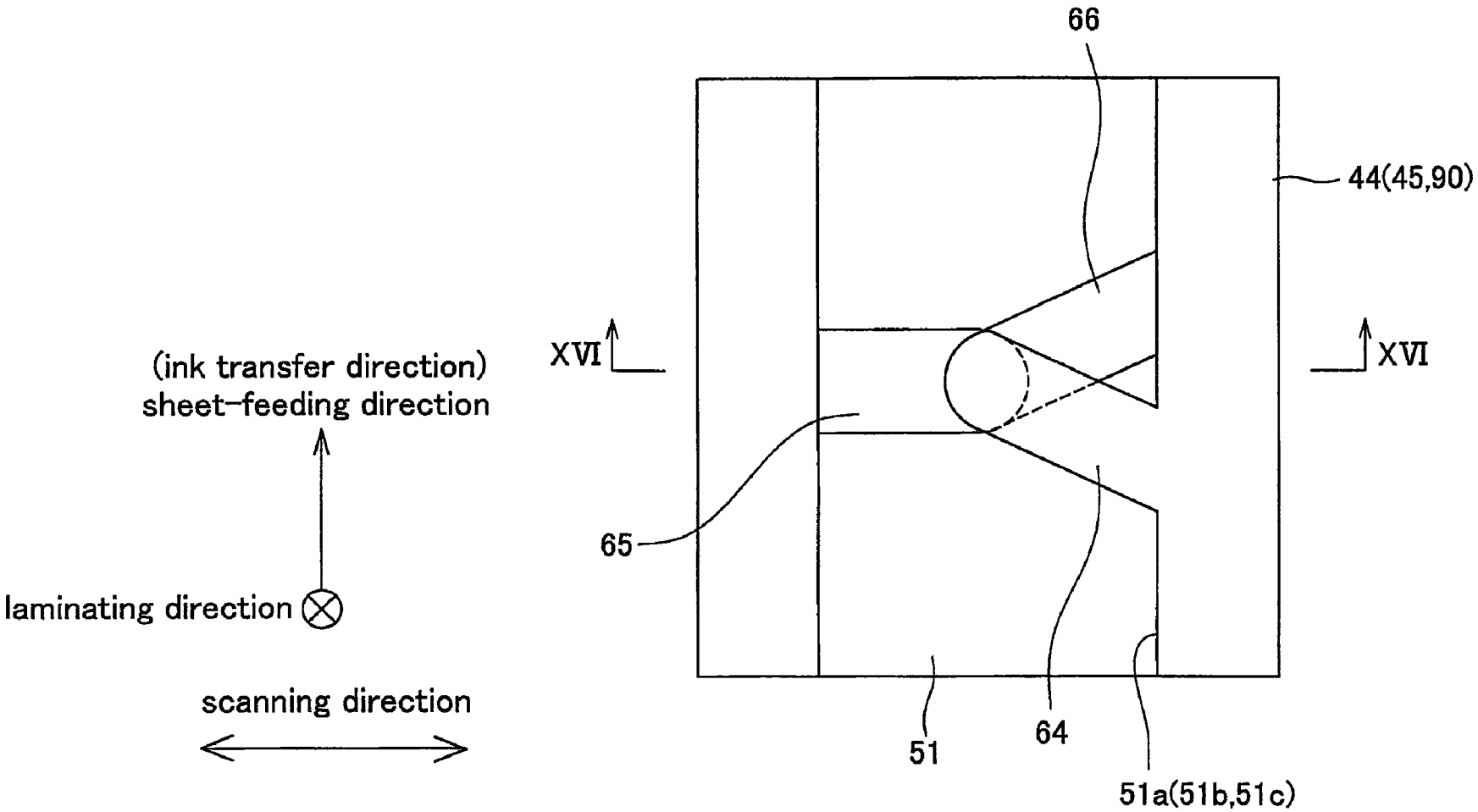
FIG. 15 is a partially enlarged top view of manifold plates in an ink-jet head of a fifth alternative example.
Figure 16:
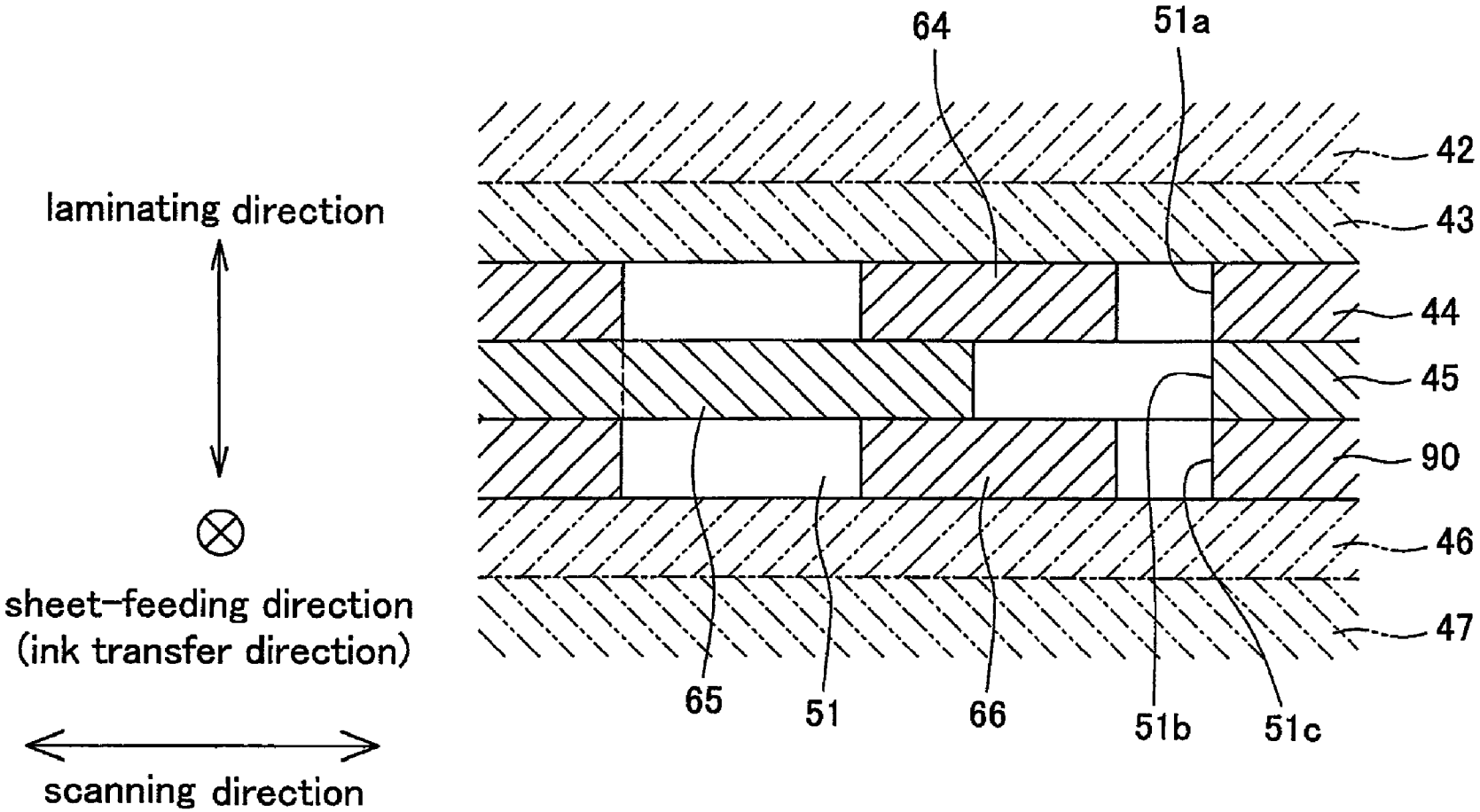
FIG. 16 is a cross sectional view taken along the line XVI-XVI of FIG. 15.

FIGS. 15 and 16 illustrate a fifth alternative example. In an ink-jet head of the present alternative example, the number of manifold plates is three instead of two. The manifold plates 44, 45, and 90 respectively have holes 51*a*, 51*b*, and 51*c* which constitute a manifold channel 51. First, second, and third projections 64, 66, and 65 respectively project inwardly from side walls defining the holes 51*a*, 51*c*, and 51*b*. The first and second projections 65 and 66 project from the one side of the side walls defining the holes 51*a* and 51*c*, whereas the third projection 65 project from the other side of the side wall defining the hole 51*b*. The first projection 64 is slanted towards downstream in the ink transfer direction. The second projection 65 extends in the width direction of the hole 51*b*. The third projection 66 is slanted towards upstream in the ink transfer direction. The tips of these projections 64 to 66 overlap one another at the middle of the width direction of the holes 51*a* to 51*c*. In the fifth alternative example, the contact position of the projections 64 and 65 and that of the projections 65 and 66 are both at the middle of the width direction of the holes 51*a* to 51*c*, and these contact positions coincide with each other in a plane view as illustrated in FIG. 15; however, the present invention is not limited thereto. The contact positions may be different positions in a plane view, that is, different positions relative to the horizontal direction.

The projections are not limited to those having a linear shape. For example, each projection may be curved or have a hook-like shape, provided that the projection does not cause an increase in the passage resistance. Further, the width of each projection, the number of projections, arrangement of the projections or the like may be suitably modified as needed.

In the foregoing embodiment, the plates 41 to 47 are bonded with one another by a metal diffusion bonding. However, these plates 41 to 47 may be bonded with one another by other methods. For example, the plates 41 to 47 may be bonded with one another by using an adhesive as follows. Namely, after a thermosetting adhesive such as epoxy base adhesive or the like is applied or after an adhesive sheet is pasted to bonding surface of each plate, the plates 41 to 47 are laminated. Then, the plates 41 to 47 are bonded with one another by applying a pressure thereto in the laminating direction, at temperatures higher than the thermosetting temperature of the adhesive or the like. This also brings about an effect that the laminating directional pressure applied to the plates 41 to 47 at the time of bonding the plates is applied through the first and second projections 64 and 65 to the portions of the plates other than the manifold plates 44 and 45, i.e. plates 41 to 43, 46 and 47, which portions facing the holes 51*a* and 51*b* in the laminating direction. The pressure therefore is dispersed, and deformation in the side walls defining the holes 51*a* and 51*b* is restrained. Further, the above mentioned problem of poor bonding among the plates is also restrained.

When an adhesive is applied or pasted to the entire bonding surface of the manifold plates 44 and 45, the adhesive applied or pasted to the first and second projections 64 and 65 may contact ink in the manifold channel 51. For this reason, it is preferable to adopt an adhesive which is not eroded by the ink.

The above embodiment deals with a case where plates 41 to 47 are bonded with one another to form a lamination, and then the nozzle plate 48 is bonded by an adhesive, with the under surface of the cover plate 47 of the lamination. The present invention however is not limited to this. For example, the nozzle plate 48 may be bonded with the cover plate 47 by using an adhesive, before forming nozzles 54. Then, the nozzles 54 may be formed on the nozzle plates 48 by applying a laser light through the holes formed on the cover plate 47. After that, the lamination of the cover plate 47 and the nozzle plate 48 may be bonded by using an adhesive with the other plates 41 to 46 which are laminated by a metal diffusion bonding.

The nozzle plate 48 is not limited to one made of synthetic resin, and may be made of metal as is the case of the other plates 41 to 47. In this case, all the plates 41 to 48 constituting the passage unit 31 are subjected to metal diffusion bonding.

The projections may contact each other by portions other than the tips thereof. Further, the projections may contact each other in any position in the manifold channel 51, provided that the projections support the plates other than the manifold plates 44 and 45, i.e. plates 41 to 43, 46 and 47, in the laminating direction. The supporter is not limited to one including plural projections contacting each other, provided that the supporter is continuous while ensuring a space for the manifold channel 51 in the laminating direction and that the supporter supports the plates 41 to 43, 46 and 47 in the laminating direction.

The present invention is applicable to not only an ink-jet head, but also a device that transfers a given liquid to a predetermined position. For example, the present invention is also applicable to a device or the like which transfers, to a predetermined position, a liquid other than ink, such as a medicinal solution, a chemical solution or the like, for a purpose other than ejecting droplets outside.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid transfer device, comprising:

a passage unit in which a common liquid chamber and a plurality of individual passages branching off from the common liquid chamber are formed, and which includes a plurality of plates which are laminated on one another and include a first plate having a hole constituting the common liquid chamber and a second plate;

an energy supplier which supplies, to liquid in the individual passages, energy for transferring the liquid; and a supporter projecting inwardly from a side wall defining the hole formed on the first plate, the supporter being continuous from one end to the other end of the common liquid chamber in a laminating direction of the plates so as to support the second plate in the laminating direction.

2. The liquid transfer device according to claim 1, wherein a plurality of the supporters are spaced from one another in the length direction of the hole.

3. The liquid transfer device according to claim 1, wherein a laminating directional cross section of a portion of the common liquid chamber, where the supporter is formed, has a shape which is point symmetrical with respect to the center of the cross section.

4. The liquid transfer device according to claim 1, wherein the supporter has a recess which constitutes a part of the common liquid chamber.

5. The liquid transfer device according to claim 1, wherein the supporter includes a plurality of projections projecting respectively from side walls of a plurality of the holes on a plurality of the first plates so as to contact each other.

6. The liquid transfer device according to claim 5, wherein the projections contact each other by tips thereof.

7. The liquid transfer device according to claim 6, wherein:

the projections project from the side walls on the same side relative to a width direction which is orthogonal to the length direction of the holes, so as to face each other in the laminating direction; and portions of the projections other than the tips are spaced from each other to form a space constituting a part of the common liquid chamber.

8. The liquid transfer device according to claim 6, wherein:

the projections has three projections projecting respectively from the side walls of three of the first plates; and the three projections includes a first projection, a second projection, and a third projection, the first and second projections projecting from side walls on the same side relative to a width direction which is orthogonal to the length direction of the hole so as to be slanted towards upstream and downstream, respectively, in a transfer direction of liquid in the common liquid chamber, and the third projection projecting from a side wall on the other side relative to the width direction so as to extend in the width direction.

9. The liquid transfer device according to claim 1, wherein the supporter includes a plurality of projections projecting respectively from one and the other side of the side wall relative to a width direction which is orthogonal to the length direction of the hole so as to contact each other.

10. The liquid transfer device according to claim 9, wherein the projections contact each other at the middle of the hole in the width direction.

11. The liquid transfer device according to claim 9, wherein the projections are slanted towards downstream in a transfer direction of liquid in the common liquid chamber.

12. The liquid transfer device according to claim 9, wherein the projections extend in the width direction.

13. The liquid transfer device according to claim 1, wherein the first and second plates are metal plates bonded with each other by metal diffusion bonding.

14. The liquid transfer device according to claim 1, wherein a plurality of the second plates are laminated on each other.

15. A method of manufacturing a liquid transfer device, the device including: a passage unit in which a common liquid chamber and a plurality of individual passages branching off from the common liquid chamber are formed; and an energy supplier which supplies, to liquid in the individual passages, energy for transferring the liquid, the method comprising the steps of:

(A) forming holes to constitute the common liquid chamber and the individual passages, on a plurality of plates included in the passage unit;

(B) laminating the plates on one another; and (C) bonding the plates having been laminated in (B) by applying a pressure in the laminating direction, wherein:

in (A), a hole constituting the common liquid chamber and a supporter projecting inwardly from a side wall defining the hole are formed on a first plate which is included in the plates; and in (B), the plates are laminated on one another so that the supporter of the first plate is continuous from one end to the other end of the common liquid chamber in the laminating direction.

16. The method according to claim 15, wherein, in (C), the first plate and a second plate which is included in the plates, both made of metal, are bonded with each other by metal diffusion bonding.

* * * * *